United States Patent [19]

Moulin

[11] 3,960,429

[45] June 1, 1976

[54] CONNECTOR ASSEMBLY WITH AXIALLY OPERABLE ENGAGEMENT MEANS

[75] Inventor: Norbert L. Moulin, Placentia, Calif.

[73] Assignee: Hughes Aircraft Company, Culver City, Calif.

[22] Filed: Aug. 29, 1974

[21] Appl. No.: 501,553

[52] U.S. Cl. ..... 339/91 R; 285/86; 339/130 C; 339/186 M

[51] Int. Cl.² ..... H01R 13/54; H01R 13/64

[58] Field of Search ..... 339/91, 89, 186, 130; 285/84, 86, 315, 316, 319

[56] References Cited

UNITED STATES PATENTS

| | | | |
|---|---|---|---|
| 2,566,993 | 9/1951 | Parsons | 339/91 R |
| 2,877,437 | 3/1959 | Flanagan, Jr. | 339/91 P |
| 3,125,395 | 3/1964 | Swanson | 339/217 S |
| 3,176,259 | 3/1965 | MacNamara | 285/319 |
| 3,277,423 | 10/1966 | Rose | 339/130 C |
| 3,471,824 | 10/1969 | Greulich et al. | 339/91 P |

*Primary Examiner*—Roy Lake
*Assistant Examiner*—Neil Abrams
*Attorney, Agent, or Firm*—Lewis B. Sternfels; W. H. MacAllister

[57] ABSTRACT

Two electrical connectors are coupled by inserting a contact protecting slotted split shroud of one connector over a mating contact body housing of the other connector. As the split shroud engages the mating housing, an enlarged ring section on the mating housing outwardly deflects the split shroud and allows the enlarged ring area of the mating housing to engage an inwardly directed relief area inside the split shroud to latch the two connectors together. A coupling ring on one connector is movable to cover the split shroud, thus locking the two connectors in their mated position by preventing the split shroud from opening if a force in the unmating direction is applied. The coupling ring is held in its locks position by detent fingers residing within a forward retaining groove in the connector. In multi-contact connectors, which require a specific orientation of mating contacts, the slots of the split shroud are unevenly angularly spaced from one another and keys on the mating housing are distributed in the same uneven pattern to permit connector mating in a single angular orientation therebetween.

7 Claims, 10 Drawing Figures

66
60
62
82
28
84
86
34
90
16
12
110
42
38
46
48
40
50
44
10
78
52
54

60
62
110
52
84
46
48
42
50
38
54
12
40
44
10
82

Fig. 7
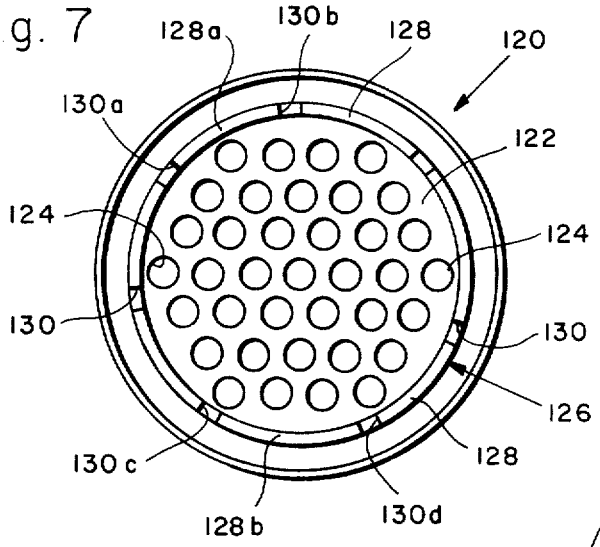
Fig. 9
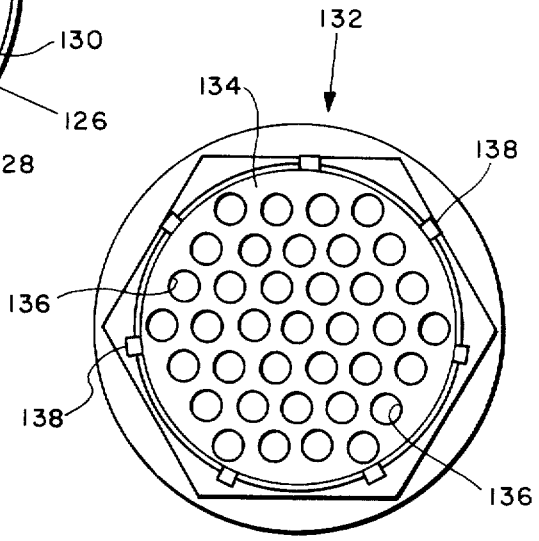
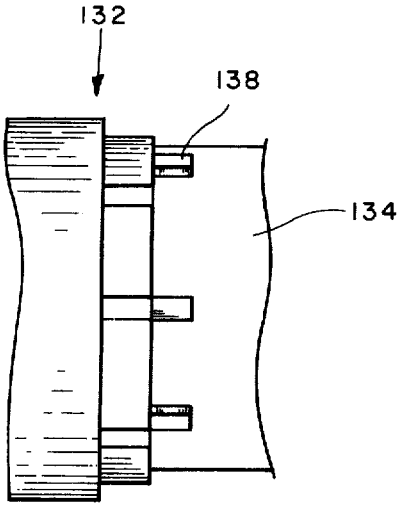
Fig. 10
Fig. 8
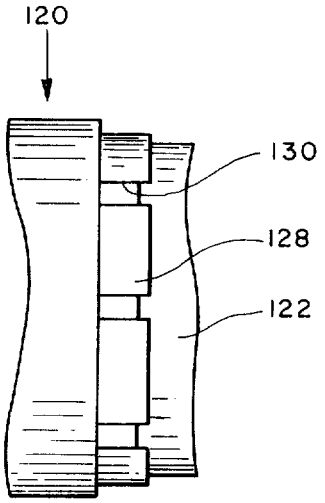

CONNECTOR ASSEMBLY WITH AXIALLY OPERABLE ENGAGEMENT MEANS

BACKGROUND OF THE INVENTION

1. Field of the Invention

The present invention relates to a connector assembly for engagement of connectors by an axial, push-pull latching interlock. Although illustratively directed toward electrical connectors, the present invention is adaptable for terminating and connecting any signal carrying means, e.g. fiber optics, and, therefore, it is not intended that the concept of the present invention be limited exclusively to electrical cable termination and connection.

2. Description of The Prior Art

Prior art connectors, specifically those having a circular cross-section, are conventionally mated and locked together by a rotatable coupling ring with a cam engaging a thread or ramp. A detent latches into a recess in the ramp to resist unthreading and resulting disengagement between the mating contacts and conductors. Such coupling engagement requires sufficient space for a hand or tool to rotate the coupling ring, thereby preventing maximum density of the number of connectors that may be provided in a given space.

Other connectors having a non-circular configuration are not adaptable to the retainable cam coupling ring but may use a cooperating nut and screw in respective connectors or other latching means to provide and maintain engagement between the connectors. Such connections schemes generally require the tool to rotate the screw or the nut, such as by an Allen-head type screw driver. Such systems, therefore, require the use of additional tools and equipment to effect the latching engagement.

In both circular and non-circular connectors, the parts are usually machine fabricated, thus resulting in expense in manufacture.

SUMMARY OF THE INVENTION

The present invention overcomes these and other problems by utilizing a "push-pull" engagement system, thereby omitting the prior art rotatable cam-coupling ring and accessory tools. In general, a split shroud on one connector having an internal recess is engageable over a mating detent on the other connector housing, allowing the split shroud to move outward and then spring back into position. An axially movable coupling ring moves from a first detent position to a second detent position and into covering relationship over the split shroud to prevent outward movement of the split shroud from engagement with the ring and to lock the two connectors in their mated position. Accordingly, connection may be made substantially from the rear end of the connector and without requiring manipulation of the latching mechanism at the mating end of the connector. The concept accordingly permits use of any materials, whether metal or plastics and, when plastics, enable construction of the connectors by injection-molding and other relatively inexpensive plastic molding processes.

It is, therefore, an object of the present invention to provide for a simplified connector engagement system.

Another object is the provision of a system enabling the use of inexpensive parts.

Another object is to provide for maximized density of connectors by decreasing the space otherwise required for hand and tool manipulation.

Another object is the provision of an engagement system which is amenable to any size connector or number of contacts.

Another object is to provide for a decreased number of basic components.

Another object is the provision of a coupling mechanism which can be made exclusively of electrically insulative or other environmental materials, aside from those required to permit the coupling of the signal carrying means, such as an electric cable or fiber optics.

Other aims and objects as well a more complete understanding of the present invention will appear from the following explanation of exemplary embodiments and the accompanying drawings thereof.

BRIEF DESCRIPTIONS OF THE DRAWINGS

FIG. 7 is an end view of a multi-contact receptacle connector;

FIG. 8 is a partial end view of the receptacle connector shown in FIG. 7;

FIG. 9 is an end view of a multi-contact plug connector; and

FIG. 10 is a partial side view of the plug connector depicted in FIG. 9.

DESCRIPTION OF THE PREFERRED EMBODIMENT

Although the following description is directed specifically to electrical connectors, it is to be understood that the concepts of the present invention are directed toward connection of any signal carrying means. Furthermore, while the following description relates to single pin or multi-pin connectors, it is to be also understood that the connectors are usable with any single, coaxial or multi-contact connector or any mixture thereof. It is to be further understood that, while a socket contact is depicted in a plug connector and a pin contact in a receptacle connector, they may be reversed.

Figure 2:
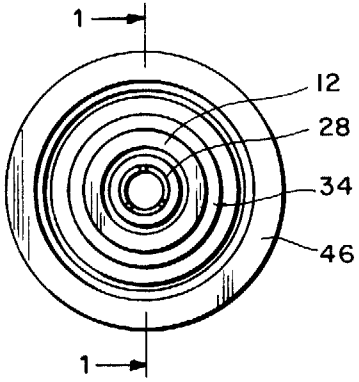
FIG. 2 is a end view of the plug connector depicted in FIG. 1.
Figure 1:
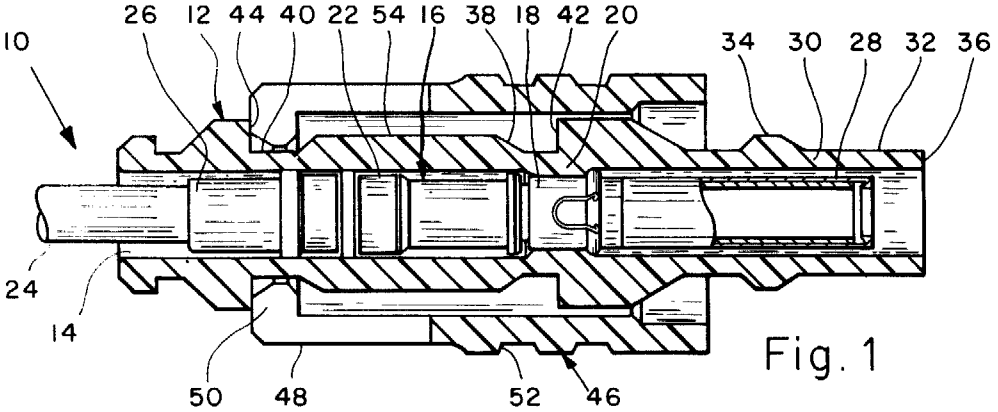
FIG. 1 is a cross-sectional view of a plug connector inclosing a single contact, taken along lines 1—1 of FIG. 2.

Accordingly, with reference to FIGS. 1 and 2, a plug connector 10 includes an insulator housing or body 12 having a bore 14 therethrough for reception of a socket contact 16 therein. The socket contact is provided with a retaining ring 18 which cooperates with an internal annular ring 20 of body 12 to latch contact 16 within socket body 12. At one end 22 of socket contact 16 is a cable 24 secured thereto in electrical engagement therewith. A seal 26, such as disclosed in U.S. Pat. No.

3,792,416, may be placed around contact end 22 and cable 24 to seal the contact and its cable within bore 14 of socket body 12. Contact 16 is further provided with a socket end 28 which is disposed to be electrically coupled with the pin end of a pin contact.

Surrounding socket end 28 is a forward housing 30 of socket body 12 having at its outer surface 32 an enlarged ring section 34 placed somewhat rearwardly of front end 36 of the socket insulation body. Placed rearwardly of enlarged ring section 34 on socket body 12 are a pair of forward and rearward retaining grooves 38 and 40 formed within outer surface 32. Each of grooves 38 and 40 are terminated by abutment shoulders 42 and 44, respectively.

Placed about socket insulation body 12 is a locking hood or coupling ring 46 having a plurality of cantilevered deflecting arms 48, which are adapted to deflect at their detent ends 50 towards or away from the axis of the plug connector. A plurality of ridges 52 are placed on the exterior of coupling ring 46 and serve as finger engagements to aid in manipulating the coupling ring from retaining groove 40 to retaining groove 38 or vice-versa over an enlarged separating portion 54 therebetween.

Figure 3:
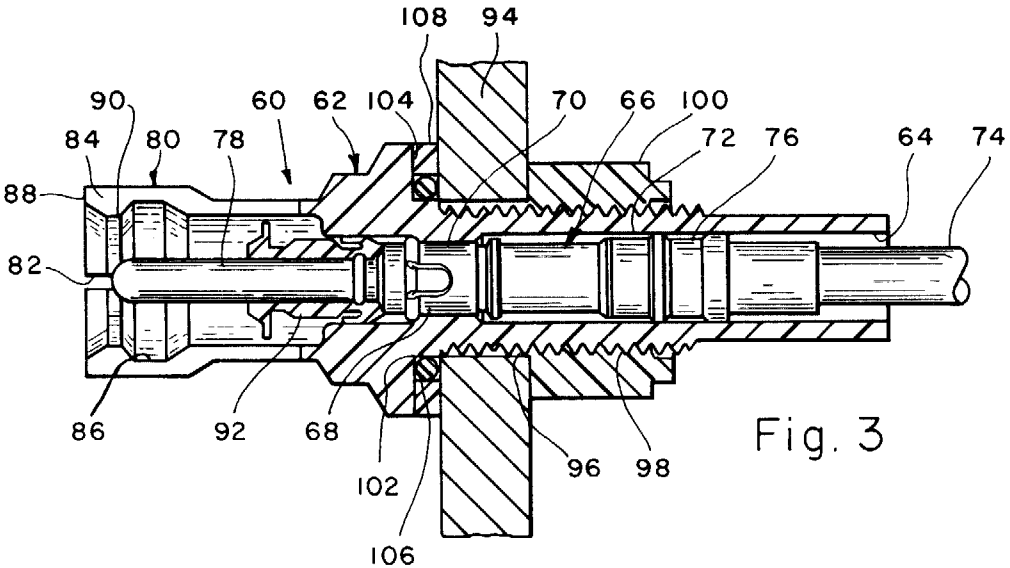
FIG. 3 is a cross-sectional view of a receptacle connector mounted in a panel and adapted for engagement with the plug connector of FIG. 1, taken along lines 3—3 of FIG. 4.
Figure 4:
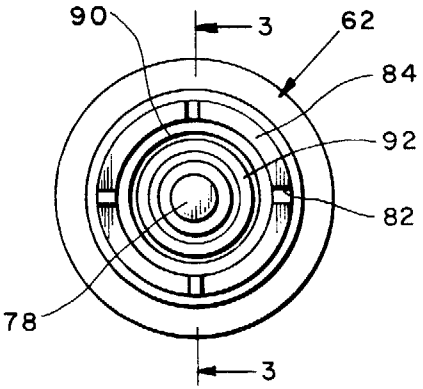
FIG. 4 is an end view of the receptacle connector depicted in FIG. 3.

Referring now to FIGS. 3 and 4, a receptacle connector 60 includes a pin insulation body 62 having an internal bore 64 therein for reciept of a pin contact 66. Pin contact 66 is retained within bore 64 by a retaining ring 68 on contact 66 cooperating with an internal annular ring 70 of housing 62. At one end 72 of contact 66 is an electrical cable 74 which is mechanically and electrically secured to the pin contact. A seal 76 also seals the pin contact within bore 64 and may be of similar configuration as seal 26. Pin contact 66 is completed at its other end with a pin 78 which is adapted to engage socket end 28 of socket contact 16.

Pin insulation body 62 has at its forward end a shroud 80 which is slotted at 82 to form a plurality of fingers 84 which are movable towards and away from the axis of receptacle connector 60. A relief or undercut area 86 is provided adjacent end 88 and is adapted to engage with enlarged ring section 34 of socket insulation body 12, slots 82 permitting cantilevered fingers 84 to move away and spring back into position as ridge 90, defining one side of undercut area 86, moves over enlarged ring section 34.

An interfacial seal 92 is provided around pin end 78 and may be constructed in the manner described in aforementioned U.S. Pat. No. 3,792,416. It is to be understood, however, that seals 26, 76 and 92 may be omitted if environmental sealing is not required.

Receptacle connector 60 may be mounted within a mounting panel 94 and within a hole 96 therein. For this purpose, pin insulation body 62 is provided with an externally threaded portion 98 for engagement thereon of a mounting nut 100. Threaded portion 98 terminates in a flat portion 102 and a rearwardly facing shoulder 104. An O-ring 106 resides on flat portion 102 and an O-ring spacer 108 of a relatively rigid material, as distinguished from O-ring 106, is placed around the O-ring. Spacer 108 is of slightly lesser thickness than the O-ring so as to permit compression of the O-ring when receptacle connector 60 is mounted within hole 96 of mounting panel 94 and mounting nut 100 is screwed onto threaded portion 98.

Figure 5:
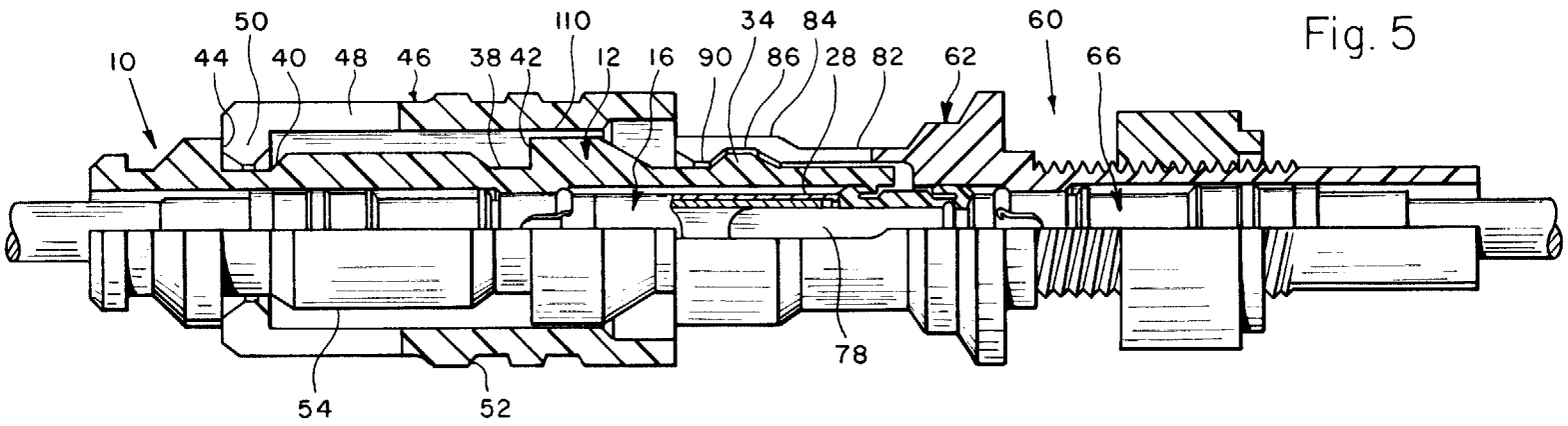
FIG. 5 depicts initial engagement between the connectors of FIGS. 1 and 3.
Figure 6:
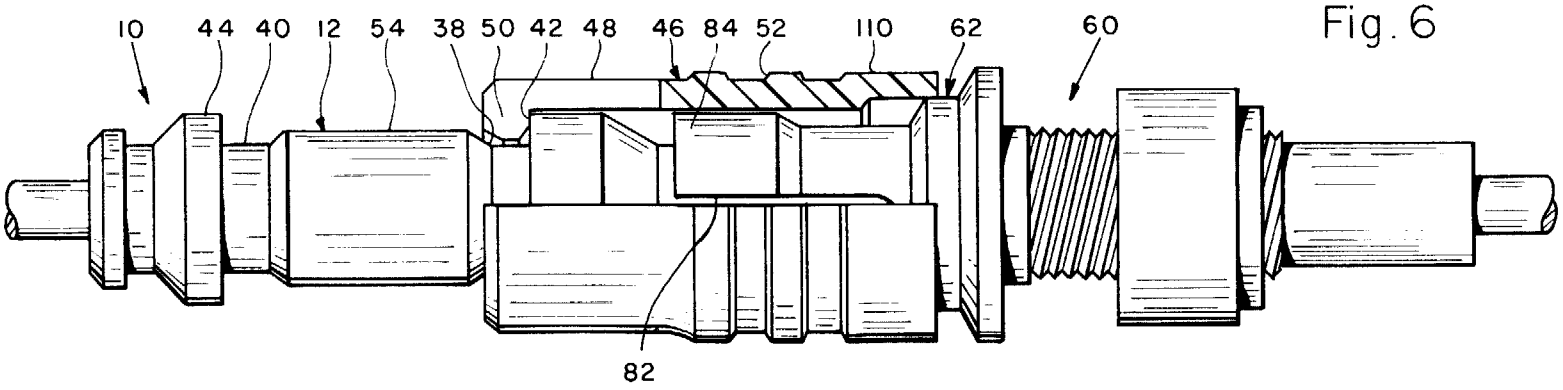
FIG. 6 depicts the engaged connectors of FIG. 5 in which the connectors are locked together and prevented from disengagement.

Operation of the engagement mechanism is depicted in FIGS. 5 and 6. Coupling ring 46 is placed in its rearward position with detents 50 engaging groove 40. Plug connector 10 is then engaged with receptacle connector 60, and pin end 78 of pin contact 66 electrically slides within socket end 28 of socket contact 16 to form an electrical coupling between the two contacts. Simultaneously, ridge 90 defining the front end of relief or undercut areas 86 moves over enlarged ring section 34 of socket insulator body 12, thereby permitting cantilevered fingers 84 of pin insulator body 82 to move outwardly and then to spring into place to form an engagement between relief area 86 and enlarged ring section 34.

As stated above, this engagement is permitted by the initial rearward position of coupling ring 46 with engagement of its detent ends 50 within rearward retaining groove 40. After engagement between large ring section 34 and undercut area 86, coupling ring 46 is then manually moved forward by the user by gripping ridges 52 of the coupling ring to move detent ends 50 over separating portion 54 and into forward retaining groove 38, into engagement against abutment shoulder 42. This movement of coupling ring 46, as depicted in FIG. 6, also moves forward portion 110 of ring 46 over cantilever fingers 84, thereby covering and preventing outward movement of the fingers and consequent disengagement between enlarged ring section 34 and relief or undercut areas 86. Disengagement of the plug and receptacle connectors is effected by reverse operation, that is, by sliding coupling ring 46 backward from groove 38 into groove 40 and against abutment shoulder 44.

Referring now to FIGS. 7 and 8, a multi-pin receptacle connector 120 is provided with a pin or socket body 122 in which a plurality of bores 124 are provided for reception of pin or socket contacts. In the same manner as depicted in FIG. 3, receptacle connector 120 is provided with a slotted shroud 126 defining a plurality of cantilevered fingers 128 separated by a plurality of slots 130. In this configuration, slots 130 have on uneven angular distribution between fingers 128 to provide wide and narrow cantilevered fingers. For example, slots **130*a* and 130*b* are placed closer to one another than slots 130*c* and 130*d* so that finger 128*a* is narrower than finger 128*b*. This configuration of fingers and slots effects a preselected orientation of receptacle connector 120 with a plug connector 132, as depicted in FIGS. 9 and 10,** in order to maintain mating electrical alignment of pins and sockets between their respective connectors.

As shown in FIGS. 9 and 10, plug connector 132 includes a socket or pin body 134 having bores 136 therein for receipt of socket or pins. Placed about the outer periphery of body 124 are a plurality of keys 138 whose annular spacing from one another has the same but mirrored configuration as slots 130 of receptacle connector 120 to establish a single preorientated mating configuration between the receptacle and plug connectors.

In a manner similarly described with FIGS. 1–6, the plug and receptacle connectors are provided with an enlarged ring section, such as large ring section 34 of FIG. 1 and relief or undercut areas, such as relief or undercut areas 86 of FIG. 3, along with a coupling ring, such as coupling ring 46 of FIG. 1. Accordingly, the connectors of FIGS. 7–10 operate in exactly the same manner as the connectors of FIGS. 1–6 with the additional feature of a preorientation built within the coupling mechanism.

Although the above description of the present invention utilizes a socket contact within a plug connector and a pin contact within a receptacle connector, the two may be exchanged as is desired. Furthermore, coupling ring 46 is shown as being on the plug connector; however, this need not be so if for some reason it is desired to have this coupling ring on the receptacle connector, the only difference being that retaining grooves 38 and 40 must also be exchanged along with the coupling ring.

Although the invention has been described with reference to particular embodiments thereof, it should be realized that various changes and modifications may be made therein without departing from the spirit and scope of the invention.

What is claimed is:

1. An electrical connector assembly comprising:

a receptacle connector having means for defining an integral molded body entirely of plastic dielectric material of generally tubular construction having front and rear ends and inner and outer surfaces for receiving and securing within said inner surface at least one electrical contact with a contact engaging end thereof positioned at said front end of said receptacle connector;

a plug connector having means for defining an integral molded body entirely of plastic dielectric material of generally tubular construction having front and rear ends and inner and outer surfaces for receiving and securing within said inner surface at least one electrical contact with a contact engaging end thereof positioned at said front end of said plug connector, and being matable with said receptacle connector for electrically coupling said contact engaging ends of said respective electrical contacts of said plug and receptacle connectors;

a first of said body means of one of said plug and receptacle connectors including a shroud integrally formed with said first body means and positioned at said front end thereof for enclosing and mechanically protecting a first of said contact engaging ends, said first body shroud comprising a plurality of fingers separated from one another by means therebetween for defining slots and secured integrally at one end of said fingers to said first body for forming a plurality of cantilevers deflectable at a second end of said fingers towards and away from said first contact engaging end, said fingers having adjacent said second ends thereof means for defining reliefs undercut into said inner surface of said first body facing towards said first contact engaging end;

a second of said body means of the other of said plug and receptacle connectors including a shroud integrally formed with said second body means and positioned at said front end thereof for enclosing and mechanically protecting a second of said second contact engaging ends, said shroud having an enlarged ring section formed on said outer surface of said second body means and facing away from said second contact engaging end for latching and engaging with said undercut relief means of said first shroud fingers, said second body means further including means for defining a pair of spaced forward and rearward annular grooves formed in said outer surface of said second body means and spaced rearwardly from said first end thereof and towards said rear end thereof, said spaced annular groove means each having an annular abutment shoulder with said abutment shoulders facing one another; and an integral molded coupling ring entirely of plastic dielectric material and of generally tubular construction having front and rear ends and positioned on said second body means for moving along said outer surface thereof, said coupling ring including a plurality of arms separated from one another by means therebetween for defining slots and integrally secured at one end thereof to said coupling ring for forming a plurality of cantilevers deflectable at a second end of said coupling ring arms towards and away from said second body means, said coupling ring arms having adjacent said second ends thereof detents facing towards said second body means for latching and engaging respectively with said spaced annular groove means and thereby for establishing a forward latching engagement with said second body means in said forward annular groove means and for aligning of said front ends of both said coupling ring and said second body means and thereby for establishing a rearward latching engagement with said second body means in said rearward annular groove means and for retracting of said coupling ring front end from said front end of said second body means;

whereby, when said plug and receptacle connectors are mated for said electrically coupling of said contact engaging ends of said respective electrical contacts, and where said coupling ring is in said rearward latching engagement of said arm detents with said second body means in said rearward annular groove means, said enlarged ring section of said second body means is in engagement with said undercut relief means of said first body means, said coupling ring being thereby moveable towards said forward latching engagement of said arm detents with said second body means in said forward annular groove means for maintaining the engagement of said enlarged ring section and said undercut relief means and thereby for preventing disengagement between said plug and receptacle connectors and uncoupling of said contact engaging ends.

2. An electrical connector assembly as in claim 1 wherein said slot means separating said plurality of fingers of said first body shroud have unequal spacing from one another in a specific radial pattern and further including keys positioned on said exterior surface and on said shroud of said second body means and between said enlarged ring section and said front end of said second body means, said keys having a radial placement about said second body shroud in the specific pattern of said first body slot means for enabling a single, orientated angular engagement between said plug and receptacle connectors.

3. An electrical connector assembly as in claim 1 wherein said body means of both said plug and receptacle connectors include means for defining a plurality of openings for receiving a plurality of said electrical contacts.

4. An electrical connector assembly as in claim 1 further comprising means for securing said receptacle connector to a mounting panel, including a shoulder on said receptacle body means facing towards the rear end thereof, a threaded portion on said receptacle body outer surface between said shoulder and said rear end for receiving of said threaded portion within means for defining a hole in said mounting panel, a deformable sealing O-ring placed about said receptacle body outer surface positioned between said shoulder and mounting panel, a substantially rigid spacer ring of lesser width than said O-ring positioned about said O-ring, and a nut threadedly engaging said threaded portion and bearing against said mounting panel for securing said mounting panel between said shoulder and said nut.

5. An electrical connector assembly as in claim 1 wherein said electrical contacts each comprise a coaxial contact.

6. A three piece connector assembly comprising:

a single piece, integral first connector having front and rear ends, and means positioned therein for terminating means for carrying signals;

a single piece, integral second connector having front and rear ends, and means positioned therein for terminating means for carrying signals, said second connector having a mating attachment with said first connector for coupling of said respective terminating means at said front ends thereof and thereby for coupling of said signal carrying means along a common axis passing through said first and second connectors;

at least one latching member integrally formed with said first connector and including a plurality of cantilevered fingers integrally secured at one end thereof to said first connector front end and terminating in freely floating second ends for enabling movement of said second ends towards and away from the axis, means for defining slots separating said plurality of cantilevered fingers and being unevenly spaced from one another for forming a specific slot pattern and for configuring said fingers with wide and narrow widths, and means in said second ends of said fingers for defining axially inwardly directed recesses;

at least one latching member integrally formed with said second connector comprising at least one axially outwardly directed protuberance for establishing the engagement thereof with said recess means in said second ends of said fingers and an engagement of said second connector latching member with said first connector latching member and for enabling the mating attachment between said first and second connectors;

a plurality of keys on said second connector having a configuration substantially identical to said specific slot pattern separating said fingers for enabling the mating attachment between said first and second connectors in a unique rotational orientation about the common axis; and a single piece, integral coupling member coupled to and axially moveable between two positions on one of said first and second connectors, and having integral means for yieldably securing said coupling member to said one connector selectively in a first and a second of the two positions, said yieldably securing means when in the first position enabling coupling of said coupling member to said first connector latching member for thereby maintaining the engagement and for preventing disengagement between said latching members of said first and second connectors, and said yieldably securing means when in the second position enabling disengagement of said coupling member from said first connector latching member for thereby enabling the disengagement of said latching members of said first and second connectors and thereby permitting uncoupling thereof from one another and said signal carrying means thereof.

7. A connector assembly as in claim 6 wherein said yieldably securing means comprises a plurality of cantilevered arms integrally secured at one end thereof to said coupling member and terminating in freely floating second ends and provided with axially inwardly directed detents, and wherein said one connector is provided with means for defining recesses in the two positions for cooperating with said detents.

* * * * *